US010746447B2

(12) United States Patent
Goel et al.

(10) Patent No.: US 10,746,447 B2
(45) Date of Patent: Aug. 18, 2020

(54) COOLING SYSTEM

(71) Applicant: Lennox Industries Inc., Richardson, TX (US)

(72) Inventors: Rakesh Goel, Irving, TX (US); Eric Giles, Royse City, TX (US); Siddarth Rajan, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 169 days.

(21) Appl. No.: 15/825,197

(22) Filed: Nov. 29, 2017

(65) Prior Publication Data

US 2019/0162458 A1 May 30, 2019

(51) Int. Cl.

| | |
|---|---|
| ***F25B 1/00*** | (2006.01) |
| ***F25B 49/02*** | (2006.01) |
| ***F25B 39/00*** | (2006.01) |
| ***F25B 49/00*** | (2006.01) |
| *F25B 39/04* | (2006.01) |

(52) U.S. Cl.

CPC ..... *F25B 49/02* (2013.01); *F25B 39/00* (2013.01); *F25B 49/005* (2013.01); *F25B 39/04* (2013.01); *F25B 2500/19* (2013.01); *F25B 2500/29* (2013.01); *F25B 2600/15* (2013.01); *F25B 2600/21* (2013.01); *F25B 2700/2106* (2013.01); *F25B 2700/21152* (2013.01)

(58) Field of Classification Search

CPC ..... F25B 49/02; F25B 39/00; F25B 2500/19; F25B 2500/29; F25B 2700/1931; F25B 2700/2106; F25B 2700/21152; F25B 2600/15; F25B 2600/21

See application file for complete search history.

(56) References Cited

U.S. PATENT DOCUMENTS

| | | | | |
|---|---|---|---|---|
| 2014/0260342 | A1* | 9/2014 | Pham | F25B 39/04 62/56 |
| 2016/0245558 | A1* | 8/2016 | Feng | F25B 9/008 |
| 2016/0370026 | A1* | 12/2016 | Denton | G05B 17/02 |
| 2018/0058740 | A1* | 3/2018 | Nishiyama | F25B 13/00 |
| 2019/0025859 | A1* | 1/2019 | Zha | G01L 27/007 |

FOREIGN PATENT DOCUMENTS

JP 3416996 B2 * 6/2003

* cited by examiner

*Primary Examiner* — Henry T Crenshaw
*Assistant Examiner* — Kamran Tavakoldavani
(74) *Attorney, Agent, or Firm* — Baker Botts L.L.P.

(57) ABSTRACT

An apparatus includes a microchannel heat exchanger, a load, a compressor, and a controller. The microchannel heat exchanger removes heat from a refrigerant. The load uses the refrigerant to remove heat from a space proximate the load. The compressor compresses the refrigerant from the load. The controller determines a discharge temperature of the refrigerant at the compressor and predicts a saturation temperature of the refrigerant between the compressor and the microchannel heat exchanger. The controller also determines a discharge superheat by subtracting the saturation temperature from the discharge temperature and triggers an alarm if the discharge superheat is below a threshold temperature.

24 Claims, 3 Drawing Sheets

COOLING SYSTEM

TECHNICAL FIELD

This disclosure relates generally to a cooling system, such as a refrigeration system.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY OF THE DISCLOSURE

This disclosure contemplates an unconventional cooling system that removes heat from a refrigerant using a microchannel heat exchanger (e.g., by discharging that heat to the outside air). The system includes a controller and/or sensors that monitor a temperature of the refrigerant at the discharge of a compressor to protect the cooling system from reaching shut down conditions. When the discharge temperature reaches certain thresholds, the controller triggers an alarm to indicate a shutdown condition. A user may respond to the alarm to prevent the system from shutting down (also referred to as tripping). Certain embodiments will be described below.

According to an embodiment, an apparatus includes a microchannel heat exchanger, a load, a compressor, and a controller. The microchannel heat exchanger removes heat from a refrigerant. The load uses the refrigerant to remove heat from a space proximate the load. The compressor compresses the refrigerant from the load. The controller determines a discharge temperature of the refrigerant at the compressor and predicts a saturation temperature of the refrigerant between the compressor and the microchannel heat exchanger. The controller also determines a discharge superheat by subtracting the saturation temperature from the discharge temperature and triggers an alarm if the discharge superheat is below a threshold temperature.

According to another embodiment, a method includes removing heat from a refrigerant using a microchannel heat exchanger and using the refrigerant to remove heat from a space proximate a load. The method also includes compressing the refrigerant from the load using a compressor and determining a discharge temperature of the refrigerant at the compressor. The method further includes predicting a saturation temperature of the refrigerant between the compressor and the microchannel heat exchanger, determining a discharge superheat by subtracting the saturation temperature from the discharge temperature, and triggering an alarm if the discharge superheat is below a threshold temperature.

According to yet another embodiment, a system includes a microchannel heat exchanger, a load, a compressor, and a controller. The microchannel heat exchanger removes heat from a refrigerant. The load receives the refrigerant from the microchannel heat exchanger and uses the refrigerant to remove heat from a space proximate the load. The compressor compresses the refrigerant from the load. The controller determines a discharge temperature of the refrigerant at the compressor and predicts a saturation temperature of the refrigerant between the compressor and the microchannel heat exchanger. The controller also determines a discharge superheat by subtracting the saturation temperature from the discharge temperature and triggers an alarm if the discharge superheat is below a threshold temperature.

Certain embodiments provide one or more technical advantages. For example, an embodiment detects that a system shutdown will occur before it occurs by monitoring a refrigerant temperature at the discharge of a compressor. As another example, an embodiment triggers an alarm before a system shutdown occurs so that the system shutdown can be prevented. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
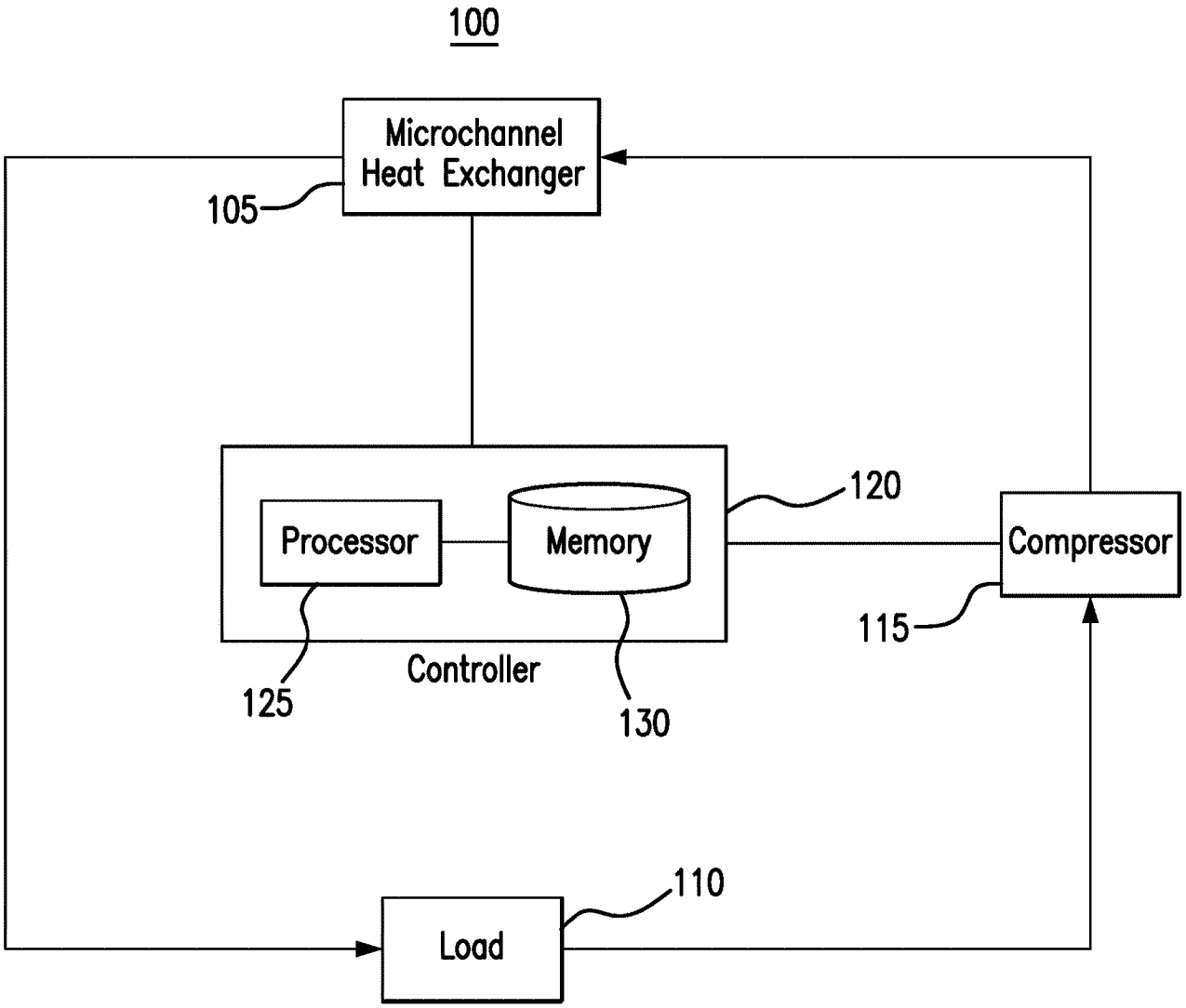
FIG. 1 illustrates portions of an example cooling system.
Figure 2:
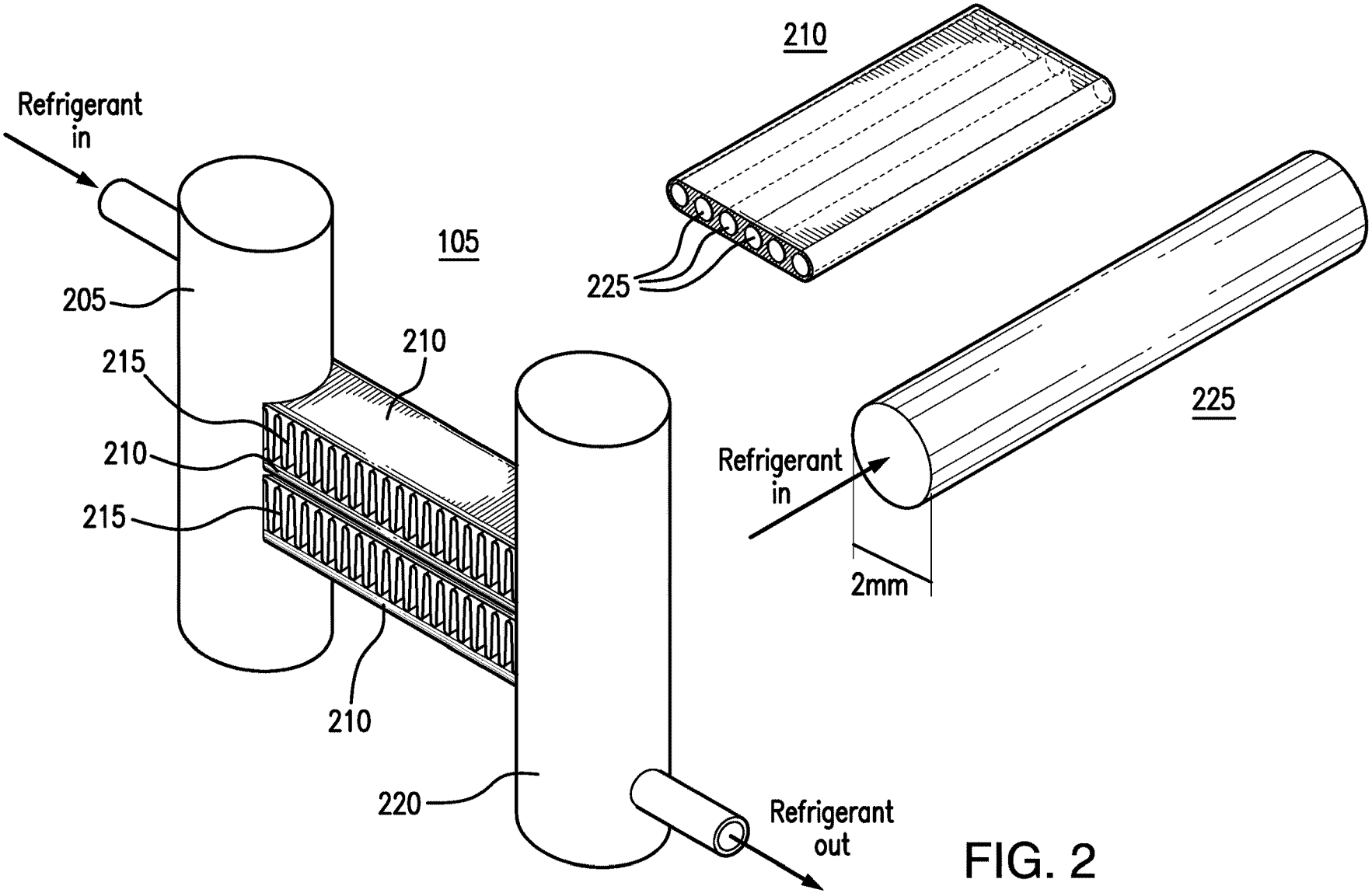
FIG. 2 illustrates an example microchannel heat exchanger of the cooling system of FIG. 1.
Figure 3:
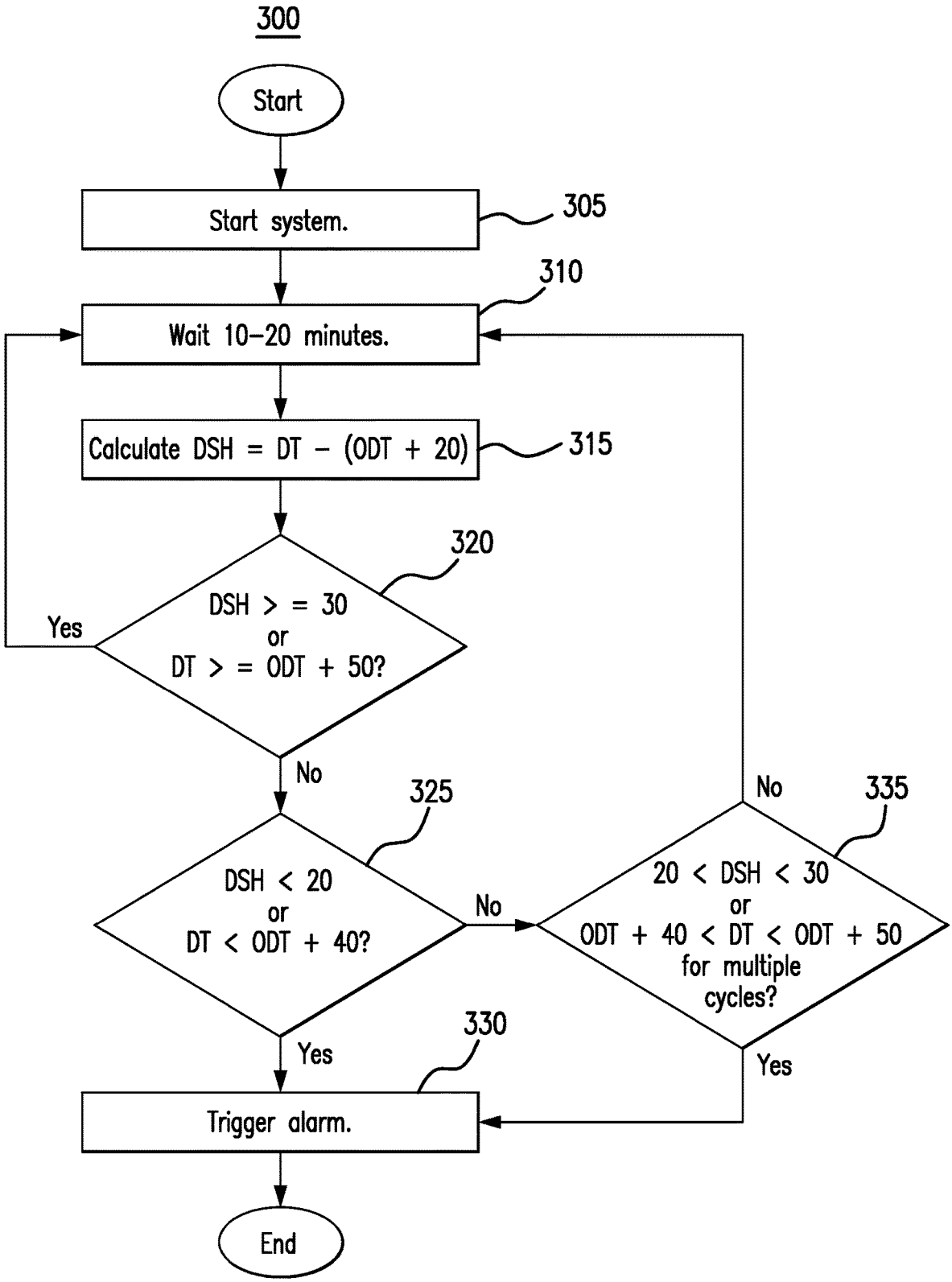
FIG. 3 is a flowchart illustrating a method for operating the cooling system of FIG. 1.

Embodiments of the present disclosure and its advantages are best understood by referring to FIGS. 1 through 3 of the drawings, like numerals being used for like and corresponding parts of the various drawings.

Cooling systems are used to cool spaces such as residential dwellings, commercial buildings, and/or refrigeration units. These systems cycle a refrigerant (also referred as charge) that is used to cool the spaces. The refrigerant absorbs heat from these spaces to cool the spaces. That heat is then removed from the refrigerant and discharged from the system. Some systems use a heat exchanger called a microchannel heat exchanger to remove heat from the refrigerant. These types of heat exchangers are typically used in systems with a small internal volume and/or a low amount of refrigerant.

One drawback of microchannel heat exchangers is that they are more susceptible to reaching higher discharge pressures causing the cooling system to shut down. For example, at high ambient temperatures, the pressure of the refrigerant may already be high and the microchannel heat exchanger may magnify fluctuations in this pressure (e.g., caused by the opening and closing of an expansion valve) until the pressure becomes critically high. As another example, in low ambient temperatures, the cooling system may turn on and off frequently. During an off cycle, liquid refrigerant may accumulate in a compressor and mix with oil in the compressor, resulting in a viscous solution. When the system turns on, the viscous solution may enter the microchannel heat exchanger and increase the pressure of the refrigerant in the system, for example, because the viscosity of the solution may make it more difficult for the solution to flow through the microchannel heat exchanger and/or because the piping in the microchannel heat exchanger may become clogged by the viscous solution. As a result, microchannel heat exchangers are more likely to cause refrigerant pressure to increase to critically high levels that cause system shutdown.

In existing installations, one way to prevent the system from shutting down is to lower the refrigerant pressure by removing refrigerant from the system when the refrigerant pressure exceeds particular thresholds. However, when refrigerant is removed from the system, the system becomes less capable of removing heat from a space and the refrigerant may need to be added back into the system at a later time through maintenance. Additionally, removing refrigerant from the system does not address the real issue that caused the shutdown.

This disclosure contemplates an unconventional cooling system that includes a controller and/or sensors that monitor a temperature of the refrigerant at the discharge of a compressor to protect the system from reaching shutdown conditions. When the discharge temperature reaches certain thresholds, the controller triggers an alarm to indicate a shutdown condition. A user or operator may respond to the alarm to prevent the system from shutting down. In certain embodiments, the user or operator may be able to diagnose other problems within the system because the alarm triggers before the pressure of the refrigerant increases to a level that causes the system to shut down. In some embodiments, the operator may diagnose the actual cause of a potential shut down because the alarm triggers before the pressure of the refrigerant reaches shutdown levels.

The unconventional system will be described using FIGS. 1 through 3. FIG. 1 illustrates portions of an example cooling system 100. As illustrated in FIG. 1, system 100 includes a microchannel heat exchanger 105, a load 110, a compressor 115, and a controller 120. In particular embodiments, controller 120 prevents system 100 from reaching shutdown conditions by monitoring a temperature of a refrigerant discharge at compressor 115.

Microchannel heat exchanger 105 may remove heat from the refrigerant. When heat is removed from the refrigerant, the refrigerant is cooled. This disclosure contemplates microchannel heat exchanger 105 being operated as a condenser, a gas cooler, and/or a fluid cooler. When operating as a condenser, microchannel heat exchanger 105 cools the refrigerant such that the state of the refrigerant changes from a gas to a liquid. When operating as a gas cooler, microchannel heat exchanger 105 cools the refrigerant but the refrigerant remains a gas. When operating as a fluid cooler, microchannel heat exchanger 105 cools the refrigerant but the refrigerant remains a fluid and/or liquid. In certain configurations, microchannel heat exchanger 105 is positioned such that heat removed from the refrigerant may be discharged into the air. For example, microchannel heat exchanger 105 may be positioned on a rooftop so that heat removed from the refrigerant may be discharged into the air. As another example, microchannel heat exchanger 105 may be positioned external to a building and/or on the side of a building.

FIG. 2 illustrates an example microchannel heat exchanger 105 of the cooling system 100 of FIG. 1. As shown in FIG. 2, microchannel heat exchanger 105 includes an inlet 205, one or more channels 210, one or more fins 215, and an outlet 220. Each channel 210 and fin 215 is positioned between inlet 205 and outlet 220. Each channel 210 has a fin 215 positioned between it and another channel 210. Most of the channels 210 (except the channels 210 at the top and bottom of microchannel heat exchanger 105) are in contact with two different fins 215. Generally, refrigerant flows into inlet 205 and through channels 210 to outlet 220. Fins 215 remove heat from the refrigerant as it flows through channels 210. Heat may be dispelled from microchannel heat exchanger 105 using fans that move air over and/or through fins 215.

As seen in FIG. 2, each channel 210 is formed using multiple smaller channels 225. The refrigerant flows through channel 210 by flowing through each smaller channel 225. Each smaller channel 225 may have a diameter less than or equal to two millimeters, for example. In particular embodiments, by directing refrigerant through smaller channels 225, it becomes easier to remove heat from the refrigerant because more surface area of the refrigerant is exposed to heat removing surfaces such as the surfaces of the smaller channels 225. As the heat is removed from the refrigerant in the smaller channels 225, the heat is directed through the body of channel 210 into one or more fins 215. Fins 215 then dispel or discharge the heat from the system. After the refrigerant flows through the smaller channels 225, the refrigerant flows into outlet 220 and into the rest of system 100, such as load 110.

Due to the structure of microchannel heat exchanger 105 and specifically the smaller channels 225, microchannel heat exchanger 105 is more susceptible to causing shutdown conditions. For example, at high ambient temperatures, the pressure of the refrigerant may already be high and microchannel heat exchanger 105 may magnify fluctuations in this pressure (e.g., caused by the opening and closing of an expansion valve) until the pressure becomes critically high. As another example, due to the size of the small channels 225 microchannel heat exchanger 105 is more susceptible to clogging caused by oil that is mixed in with the refrigerant. This oil may be mixed into the refrigerant when the refrigerant is compressed at compressor 115. The oil may not be able to flow through the smaller channels 225 thereby causing the smaller channels 225 to become clogged. As the smaller channels 225 become clogged, it becomes more difficult for microchannel heat exchanger 105 to remove heat from the refrigerant. As a result, the pressure in the refrigerant rises which may cause system 100 to shut down.

In existing systems, an operator of system 100 may not detect a problem until system 100 shuts down. When system 100 shuts down, the operator may detect that the pressure of the refrigerant has exceeded a threshold which caused system 100 to shut down. As a result, the operator may release the refrigerant from system 100 to reduce the pressure. Releasing the refrigerant causes system 100 to be less capable of removing heat from a space. Additionally, releasing refrigerant does not address the actual causes of system 100 shutting down such as, for example, the outdoor temperature and/or clogging. In particular embodiments, system 100 triggers an alarm that alerts the operator of a shutdown condition before the refrigerant pressure exceeds the threshold. By responding to the alarm, the operator may be able to diagnose the actual cause of a shutdown before the shutdown occurs.

Refrigerant may flow to load 120. When the refrigerant reaches load 120, the refrigerant removes heat from air around load 120. As a result, that air is cooled. The cooled air may then be circulated such as, for example, by a fan, to cool a space, which may be a room of a building. As refrigerant passes through load 120, the refrigerant may change from a liquid state to a gaseous state. This disclosure contemplates load 120 being any suitable device for transferring heat to the refrigerant. For example, load 120 may be an evaporator, a heat exchanger, and/or a coil.

Refrigerant may flow from load 110 to compressor 115. This disclosure contemplates system 100 including any number of compressors 115. Compressor 115 may be configured to increase the pressure of the refrigerant. As a result, the heat in the refrigerant may become concentrated and the refrigerant may become a high pressure gas. Compressor 115 may then send the compressed refrigerant to microchannel heat exchanger 105. Compressor 115 may be a variable speed compressor that operates at various speeds depending on the needs of system 100. For example, when the cooling demands of system 100 are great, compressor 115 may operate at a high speed. When the cooling demands of system 100 are low, compressor 115 may operate at a low speed.

Controller 120 may control the operation of various components of system 100. For example, controller 120 may turn on or off compressor 115 to circulate refrigerant through system 100. Controller 120 may also detect refrigerant temperature at various portions of system and 100 and trigger appropriate alarms. As shown in FIG. 1, controller 120 includes a processor 125 and a memory 130. This disclosure contemplates processor 125 and memory 130 being configured to perform any of the functions of controller 120 described herein.

Processor 125 may be any electronic circuitry, including, but not limited to microprocessors, application specific integrated circuits (ASIC), application specific instruction set processor (ASIP), and/or state machines, that communicatively couples to a memory 130 and controls the operation of system 100. The processor 125 may be 8-bit, 16-bit, 32-bit, 64-bit or of any other suitable architecture. The processor 125 may include an arithmetic logic unit (ALU) for performing arithmetic and logic operations, processor registers that supply operands to the ALU and store the results of ALU operations, and a control unit that fetches instructions from memory 130 and executes them by directing the coordinated operations of the ALU, registers and other components. The processor 125 may include other hardware and software that operates to control and process information. The processor 125 executes software stored on memory to perform any of the functions described herein. The processor 125 controls the operation and administration of system 100 by processing information from controller 120, sensor(s), and memory 130. The processor 125 may be a programmable logic device, a microcontroller, a microprocessor, any suitable processing device, or any suitable combination of the preceding. The processor 125 is not limited to a single processing device and may encompass multiple processing devices.

The memory 130 may store, either permanently or temporarily, data, operational software, or other information for the processor 125. The memory 130 may include any one or a combination of volatile or non-volatile local or remote devices suitable for storing information. For example, the memory 130 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in the memory 130, a disk, a CD, or a flash drive. In particular embodiments, the software may include an application executable by the processor 125 to perform one or more of the functions described herein.

Controller 120 protects system 100 from reaching a shutdown condition by monitoring a temperature of the refrigerant at the discharge of compressor 115. If the discharge temperature reaches a particular value, controller 120 triggers an alarm to alert an operator of the shutdown condition. In particular embodiments, controller 120 uses a temperature sensor to detect the temperature of the refrigerant at the discharge of the compressor 115. The temperature sensor communicates the detected temperature in the form of an electric signal to controller 120. Controller 120 determines the temperature of the refrigerant based on this electric signal. Controller 120 then predicts a saturation temperature of the refrigerant between the compressor 115 and the microchannel heat exchanger 105. The predicted saturation temperature is the temperature at which the refrigerant is predicted to turn from a liquid to a gas. The controller then determines a discharge superheat by subtracting the predicted saturation temperature from the detected discharge temperature. Finally, if the discharge superheat is below a certain threshold, controller 120 triggers an alarm to alert an operator of a potential shutdown condition. In particular embodiments, if the discharge superheat is below 15 to 20 degrees Fahrenheit, then controller 120 triggers the alarm.

In particular embodiments, controller 120 may predict the saturation temperature based on an outdoor temperature. For example, controller 120 may include a temperature sensor that detects the temperature of the outdoor environment, for example, the environment external to microchannel heat exchanger 105. Controller 120 may determine that the saturation temperature is the outdoor temperature plus a constant. The constant may be derived empirically. For example, it may be determined that the constant is any temperature from 18 degrees Fahrenheit to 22 degrees Fahrenheit. Controller 120 may assume a default constant of 20 degrees Fahrenheit in particular embodiments.

In particular embodiments, controller 120 may concatenate the calculations and simply measure the outdoor temperature and the temperature of the refrigerant at the discharge of compressor 115. If the discharge temperature is below the detected outdoor temperature plus 40 degrees Fahrenheit, then controller 120 may trigger the alarm. This disclosure contemplates the constant being any suitable temperature such as, for example, any temperature from 35 degrees Fahrenheit to 45 degrees Fahrenheit.

In particular embodiments, controller 120 may trigger the alarm if the temperature of the refrigerant at the discharge of compressor 115 is above a detected outdoor temperature plus a first constant and below the detect outdoor temperature plus a second constant. In other words, controller 120 triggers the alarm if the discharge temperature of the refrigerant falls within a particular range of temperatures defined by the outdoor temperature. Controller 120 does not trigger the alarm if the discharge temperature falls outside this range.

FIG. 3 is a flowchart illustrating a method 300 for operating the cooling system 100 of FIG. 1. In particular embodiments, controller 120 performs method 300. By performing method 300, controller 120 may allow an operator to properly diagnose the cause of a shutdown condition in system 100 before system 100 reaches the shutdown condition.

In step 305, controller 120 starts the system. Controller 120 then waits 10 to 20 minutes in step 310 for the system to reach a steady state operation. Controller 120 then proceeds to step 315 to calculate a discharge superheat. In particular embodiments, controller 120 may calculate the discharge superheat by detecting a discharge temperature of the refrigerant at the discharge of a compressor and by detecting the outdoor temperature such as, for example, the temperature of an environment external to a microchannel heat exchanger. Controller 120 then calculates the discharge superheat by subtracting the detected outdoor temperature plus a constant such as, for example, 20 degrees Fahrenheit from the detected discharge temperature.

In step 320, controller 120 determines whether the calculated discharge superheat is greater than or equal to a threshold temperature such as, for example, 30 degrees Fahrenheit, 15 degrees Fahrenheit, or 20 degrees Fahrenheit, or controller 120 determines whether the measured discharge temperature is greater than or equal to the detected outdoor temperature plus a constant such as, for example, 50 degrees Fahrenheit or 30 degrees Fahrenheit. If the discharge superheat exceeds the threshold or if the discharge temperature exceeds the threshold, then controller 120 determines that the system is operating normally and returns to step 310. If controller 120 determines that this charge superheat is below the threshold or the measured discharge temperature is below the threshold, then controller 120 proceeds to step 325 to determine if a shutdown condition is imminent. In step 325, controller 120 determines whether the discharge superheat is below a threshold such as, for example, 20 degrees Fahrenheit or if the discharge temperature is below a threshold such as, for example, the outdoor temperature plus a constant such as, for example, 40 degrees Fahrenheit. If either of these conditions are evaluated to true, controller 120 proceeds to step 330 to trigger the alarm. The alarm may alert an operator that a shutdown condition is imminent.

If controller 120 determines that the discharge superheat and the discharge temperature are above the respective threshold in step 325, then controller 120 may proceed to step 335 to monitor system 100 to see if a shutdown condition becomes imminent. In step 335, controller 120 determines whether the discharge superheat falls between a range of temperatures such as, for example, 20 degrees Fahrenheit and 30 degrees Fahrenheit, or if the discharge temperature falls between two thresholds such as, for example, the outdoor temperature plus 40 degrees Fahrenheit and 50 degrees Fahrenheit for multiple operating cycles of system 100. If the discharge superheat or the discharge temperature falls within their respective ranges for multiple operating cycles, controller 120 may determine that a shutdown condition is imminent and trigger the alarm in step 330. However, if the discharge superheat and discharge temperature fall out of these temperature threshold ranges, then controller 120 may determine that system 100 is returning to normal operation and proceed back to step 310 to continue monitoring system 100.

Modifications, additions, or omissions may be made to method 300 depicted in FIG. 3. Method 300 may include more, fewer, or other steps. For example, steps may be performed in parallel or in any suitable order. While discussed as system 100 (or components thereof) performing the steps, any suitable component of system 100 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising: a microchannel heat exchanger configured to remove heat from a refrigerant;
a load;
a compressor configured to compress the refrigerant from the load; and
a controller configured to:
determine a discharge temperature of the refrigerant at the compressor;
predict a saturation temperature of the refrigerant between the compressor and the microchannel heat exchanger;
determine a discharge superheat by subtracting the saturation temperature from the discharge temperature; and
trigger an alarm if the discharge superheat is below a threshold temperature, and if the discharge superheat is above the threshold temperature and below a second threshold temperature for multiple cycles.

2. The apparatus of claim 1, wherein the microchannel heat exchanger comprises a channel through which the refrigerant flows, the channel having a diameter less than or equal to 2 millimeters.

3. The apparatus of claim 1, wherein the controller predicts the saturation temperature by:
determining an outdoor temperature; and
adding a constant to the outdoor temperature to produce the predicted saturation temperature.

4. The apparatus of claim 3, wherein the constant is 20 degrees Fahrenheit.

5. An apparatus comprising:
a microchannel heat exchanger configured to remove heat from a refrigerant;
a load;
a compressor configured to compress the refrigerant from the load; and
a controller configured to:
determine a discharge temperature of the refrigerant at the compressor;
predict a saturation temperature of the refrigerant between the compressor and the microchannel heat exchanger;
determine a discharge superheat by subtracting the saturation temperature from the discharge temperature; and
trigger an alarm if the discharge superheat is below a threshold temperature, and if the discharge temperature is below an outdoor temperature plus a constant.

6. The apparatus of claim 5, wherein the constant is 40 degrees Fahrenheit.

7. The apparatus of claim 5, wherein the controller is further configured to trigger the alarm if the discharge temperature is above the outdoor temperature plus a second constant and below the outdoor temperature plus a third constant.

8. The apparatus of claim 7, wherein the second constant is 40 degrees Fahrenheit and the third constant is 50 degrees Fahrenheit.

9. A method comprising:
removing heat from a refrigerant using a microchannel heat exchanger;
using the refrigerant to remove heat from a space proximate a load;
compressing the refrigerant from the load using a compressor;
determining a discharge temperature of the refrigerant at the compressor;

predicting a saturation temperature of the refrigerant between the compressor and the microchannel heat exchanger;

determining a discharge superheat by subtracting the saturation temperature from the discharge temperature; and triggering an alarm if the discharge superheat is below a threshold temperature, and if the discharge superheat is above the threshold temperature and below a second threshold temperature for multiple cycles.

10. The method of claim 9, wherein the microchannel heat exchanger comprises a channel through which the refrigerant flows, the channel having a diameter less than or equal to 2 millimeters.

11. The method of claim 9, wherein predicting the saturation temperature comprises:

determining an outdoor temperature; and adding a constant to the outdoor temperature to produce the predicted saturation temperature.

12. The method of claim 11, wherein the constant is 20 degrees Fahrenheit.

13. A method comprising:

removing heat from a refrigerant using a microchannel heat exchanger;

using the refrigerant to remove heat from a space proximate a load;

compressing the refrigerant from the load using a compressor;

determining a discharge temperature of the refrigerant at the compressor;

predicting a saturation temperature of the refrigerant between the compressor and the microchannel heat exchanger;

determining a discharge superheat by subtracting the saturation temperature from the discharge temperature; and triggering an alarm if the discharge superheat is below a threshold temperature, and if the discharge temperature is below an outdoor temperature plus a constant.

14. The method of claim 13, wherein the constant is 40 degrees Fahrenheit.

15. The method of claim 13, further comprising triggering the alarm if the discharge temperature is above the outdoor temperature plus a second constant and below the outdoor temperature plus a third constant.

16. The method of claim 15, wherein the second constant is 40 degrees Fahrenheit and the third constant is 50 degrees Fahrenheit.

17. A system comprising:

a microchannel heat exchanger configured to remove heat from a refrigerant;

a compressor configured to compress the refrigerant; and a controller configured to:

determine a discharge temperature of the refrigerant at the compressor;

predict a saturation temperature of the refrigerant between the compressor and the microchannel heat exchanger;

determine a discharge superheat by subtracting the saturation temperature from the discharge temperature; and trigger an alarm if the discharge superheat is below a threshold temperature, and if the discharge superheat is above the threshold temperature and below a second threshold temperature for multiple cycles.

18. The system of claim 17, wherein the microchannel heat exchanger comprises a channel through which the refrigerant flows, the channel having a diameter less than or equal to 2 millimeters.

19. The system of claim 17, wherein the controller predicts the saturation temperature by:

determining an outdoor temperature; and adding a constant to the outdoor temperature to produce the predicted saturation temperature.

20. The system of claim 19, wherein the constant is 20 degrees Fahrenheit.

21. A system comprising:

a microchannel heat exchanger configured to remove heat from a refrigerant;

a compressor configured to compress the refrigerant; and a controller configured to:

determine a discharge temperature of the refrigerant at the compressor;

predict a saturation temperature of the refrigerant between the compressor and the microchannel heat exchanger;

determine a discharge superheat by subtracting the saturation temperature from the discharge temperature; and trigger an alarm if the discharge superheat is below a threshold temperature, and if the discharge temperature is below an outdoor temperature plus a constant.

22. The system of claim 21, wherein the constant is 40 degrees Fahrenheit.

23. The system of claim 21, wherein the controller is further configured to trigger the alarm if the discharge temperature is above the outdoor temperature plus a second constant and below the outdoor temperature plus a third constant.

24. The system of claim 23, wherein the second constant is 40 degrees Fahrenheit and the third constant is 50 degrees Fahrenheit.

* * * * *